United States Patent [19]

Brown

[11] 4,386,575

[45] Jun. 7, 1983

[54] BOAT ANCHOR

[76] Inventor: Robert F. Brown, 2625 State Rd. 590, Apt. 2524, Clearwater, Fla. 33519

[21] Appl. No.: 218,468

[22] Filed: Dec. 22, 1980

[51] Int. Cl.[3] ..... B63B 21/46

[52] U.S. Cl. ..... 114/299; 114/297; 114/303

[58] Field of Search ..... 114/94–311; 52/162, 163, 166

[56] References Cited

U.S. PATENT DOCUMENTS

| | | | |
|---|---|---|---|
| 2,366,997 | 1/1945 | Brand | 52/160 |
| 2,593,111 | 4/1952 | Crawford et al. | 114/305 |
| 2,748,741 | 6/1956 | Abbott | 114/302 |
| 2,863,535 | 12/1958 | Clapper | 52/161 |
| 3,071,095 | 1/1963 | Davis | 114/305 |
| 3,621,806 | 11/1971 | Brown | 114/305 |
| 3,651,777 | 3/1972 | Ehrlichmann | 114/305 |
| 3,780,688 | 12/1973 | Hungerford | 114/309 |

*Primary Examiner*—Galen L. Barefoot
*Assistant Examiner*—Stephen P. Avila

[57] ABSTRACT

A dynamic anchor composed of two laterally positioned anchor flukes for facile penetration into the bottom structure of a water course, and a retractor to withdraw the flukes from the bottom. The retractor is mounted for relative reciprocal movement along the longitudinal axis of between the flukes. Two anchor cables are employed. The first cable is connected directly to the fluke plate and is used to anchor the craft. By pulling the first cable, the fluke plate is pulled forward to dig in and hold the craft. The second cable is reaved around a pivot carried by the retractor and is secured to the fluke plate. Thus when the second cable is pulled in, there is created a force to pull the retractor and fluke plate in opposite directions in order to cause the flukes to be removed from the water course bottom.

4 Claims, 8 Drawing Figures

FIG. 1
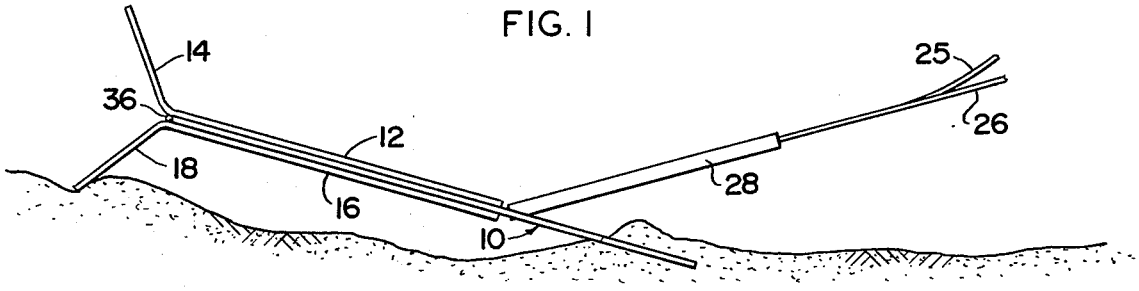
FIG. 6
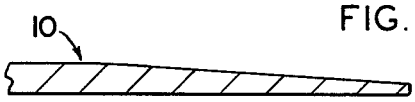
FIG. 2
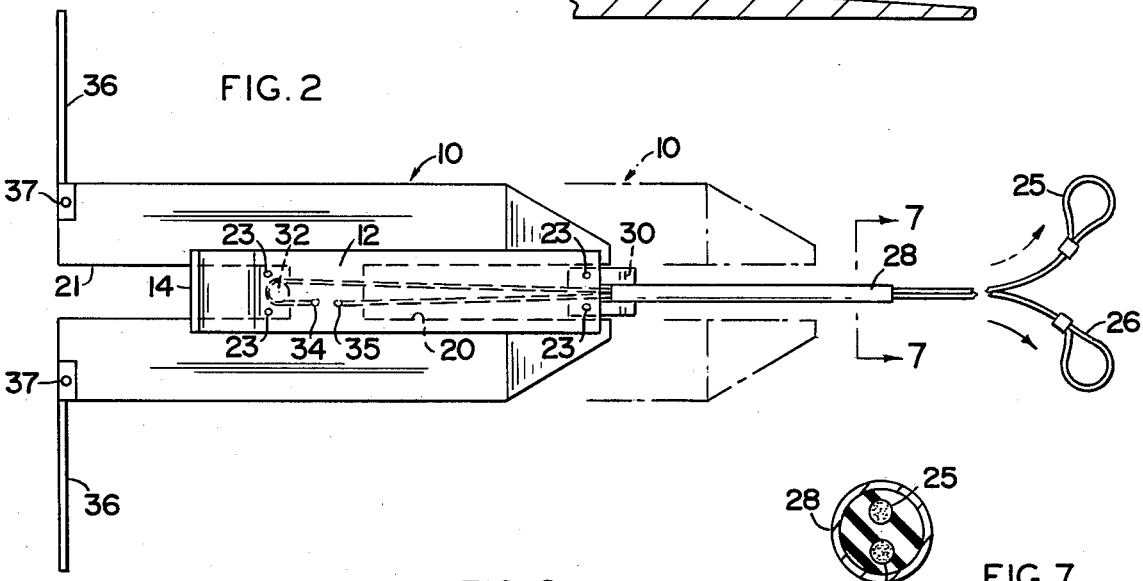
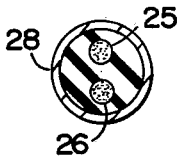
FIG. 7
FIG. 3
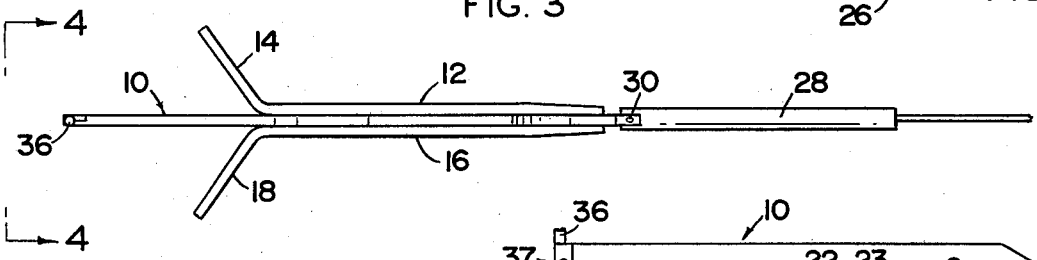
FIG. 5
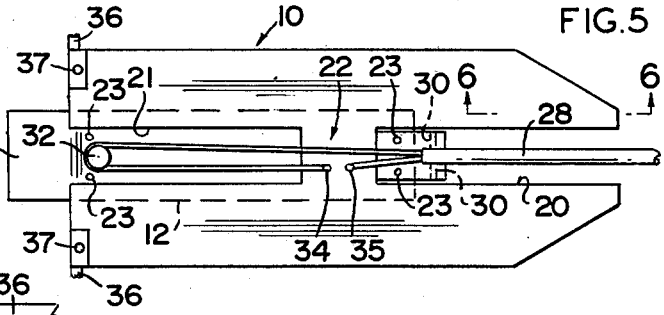
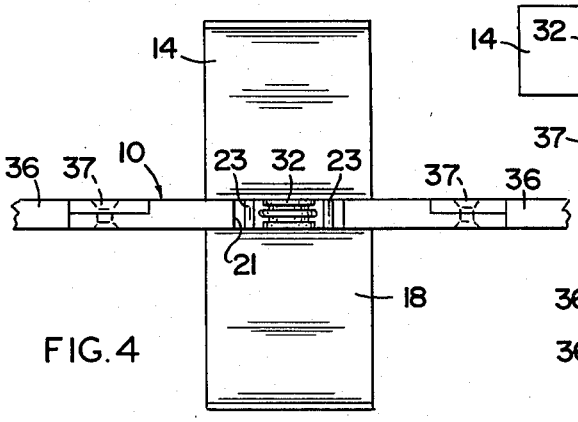
FIG. 4
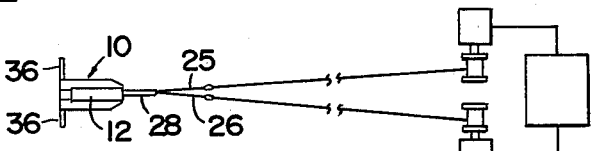
FIG. 8

BOAT ANCHOR

BACKGROUND OF THE INVENTION

1. Field of the Invention

This invention relates to boat anchors in general, and more specifically relates to a dynamic anchor. The anchor is a flat plate structure roughly corresponding in action to the fluke of a conventional anchor. A conventional anchor fluke is flat and pointed to easily penetrate the bottom structure. This invention differs in that a retractor will pull the fluke out of the water course bottom structure.

2. Description of the Prior Art

Generally, anchors are weighted, large, double hook objects to drag the sea floor and give stability to a vessel. Flukes are added at the point end of the hooks in order that the mass of the anchor, the leverage of the shank, and forward drag will cause the fluke to penetrate into the bottom material.

However, anchors vary anywhere from a heavy weight on a rope to stabilize the fisherman's rowboat, to a twenty-one thousand pound battleship anchor. In former times, the largest anchor, and the one on which most dependency was placed, was the "sheet" anchor. Then came the "bower", the "small bower", the "stream" anchor and the "kedge" anchor.

Except for the rowboat weight anchor, these are all devices acting on basically the same hook principle to hold a ship in a local position. The Brown patent U.S. Pat. No. 3,621,806 has hooks which are housed in a casing to be extended for active duty, and which are drawn back into the housing to free the anchor.

Although the Brown anchor could be activated after it becomes partially buried, there is no active interplay of parts to cause the anchor to retract from the bottom soil of the water course.

SUMMARY OF THE INVENTION

A dynamic anchor which is principally equipped to extract itself from the water course bottom, in contrast to one which is simply a weight and/or hook to drag the bottom and must be withdrawn by brute force.

This invention is composed of a main flat fluke plate, which, when buried in the bottom structure, offers significant holding capability other than by weight.

The anchor is composed of the plate and a secondary anchor which are coupled for longitudinal, relative shifting movement. The secondary anchor is equipped with angled ends which drag over the bottom structure to provide a working reference base. The plate is oppositely characterized. It will offer little resistance to slicing into the water course bottom structure or retracting therefrom, due to its broad flat configuration.

Drive means then are employed to use the secondary anchor to form a firm base to drive the flat plate from the structure of the water course bottom using the resistance of the secondary anchor against longitudinal shifting. Thus the flat plate is forced into the structure by forward pull, such as normal anchor function, and then is withdrawn by activating the cable that draws the two sections into a unitary position. Since the secondary anchor will resist movement, the tendency is for the fluke plate to withdraw and be freed from the bottom structure.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a side view of the anchor in position on the bottom of a water course in position to begin a forward thrust;

FIG. 2 is a plan view of the anchor in FIG. 1 with phantom lines showing an advance of the anchor flukes;

FIG. 3 is a side elevation of the anchor;

FIG. 4 is a rear view of the anchor;

FIG. 5 is a top plan view with one of the secondary anchor sections removed to reveal a drive cable plan;

FIG. 6 is a sectional view along the line 6—6 of FIG. 5;

FIG. 7 is a section taken along line 7—7 of FIG. 2; and

FIG. 8 is a schematic of a cable drive system for actuating the dynamic anchor.

Similar reference characters refer to similar parts throughout the several views of the drawings.

DETAILED DESCRIPTION

This invention differs from the construction of conventional anchors wherein there is a hook formation with a long shank that produces the elongation necessary for the fluke of the anchor to impale the water course bottom. It also differs in a major concept in that the fluke of the anchor, once impaled into the bottom structure of a water course, is capable of backing out of the bottom structure without requiring a forcible tearing of the bottom structure. Conventional anchors must tear loose from the overburden whenever a lifting force is applied to the angled stem of the impaled anchor. This invention backs away and pulls the fluke of the anchor out in a clean knifing action.

To accomplish this superior anchoring function, a primary anchor fluke plate 10 is employed as the structure which cuts into the bottom structure in the manner of the fluke in a conventional anchor. A flat plate is driven in a forwardly and downwardly oriented direction to penetrate the water course bottom structure and provide the holding power for the vessel attached to the anchor. In FIG. 6 of the drawing, it will be noted that the forward edge of the plate 10 is tapered to a relatively fine penetrating end.

A conventional anchor is removed from the water course bottom by applying a vertical lifting force on the shank which then produces a component of force causing a rotation of the anchor about the juncture of the shank with the fluke, and thereby tears the anchor from the water course bottom.

This invention provides a retracting action. In theory, a single retractor 12 will suffice, but when the anchor is dropped into the water, there is no way to insure which side of the fluke plate 10 will be downwardly facing against the water course bottom. Accordingly, the retractor is provided as a mirror image double retractor embodying a second retractor 16. Retractor 12 is provided with an angled end 14 and the anchor retractor 16 is provided with an angled end 18. Therefore, as shown in FIG. 1, regardless of which end ultimately faces downwardly, one of the retractors will provide an elevated support for the rear of the anchor and cause a downwardly sloping attitude for the plate 10. This is illustrated best in FIG. 1 of the drawing.

FIG. 1 also illustrates that only one retractor and angled end is required for anchoring action, and the duplicate anchor retractor is provided simply to insure functional placement of the anchor on the bottom of the water course. Hence, it may be referred to as an anchor retractor in a singular when referring to the definition of the invention.

The anchor fluke plate 10 is slotted from the nose end inwardly along the longitudinal axis. This slot is indicated by reference character 20. Also, a similar axial slot 21 opens from the rear end of the plate. The two slots leave a remainder bridge area 22 to thereby unify the resultant bifurcated plate.

The two anchor retractors 12 and 16 are then joined by spacer fastener posts 23 which also act as guides to permit longitudinal shifting movement of the composite anchor retractor 12 and 16 with respect to the bifurcated fluke plate 10.

The illustrated embodiment is obviously subject to vast modifications of means for producing an anchor retractor couple and means to mount the primary fluke plate and the anchor retractor couple together for relative longitudinal shifting movement along a common axis.

Cables 25 and 26 are carried in a sheath 28, at least for a distance from the anchor and sheath 28 is pivotally attached at 30 to the forward end of the composite anchor retractor. The cable 25 exits from the sheath 28 into the space between the retractors 12 and 16 and extends to a turnpost 32 positioned about the point of departure of the angled ends 14 and 18. Cable 25 then returns around post 32 to an anchor point 34 on the bridge 22. In actual practice, the thickness of the bridge 22 is sufficient that a longitudinal bore may preferably be provided through the bridge and the anchored end placed in that bore, but the grounding of the cable at point 34 is more efficiently illustrated as shown in FIG. 5 of the drawing.

Likewise the cable 26 passes through the sheath 28 and exits between the retractors 12 and 16, and proceeds directly to anchor point 35 carried on the bridge 22. Again, a longitudinal bore is preferably provided through the bridge for the terminal end of the cable 26, but is better illustrated for teaching purposes as shown in FIG. 5.

The operation of the structure as thus far described is quite apparent. As the anchor reaches the bottom of the water course, it may be pulled forward by the cable 26 and due to the angulation as shown in FIG. 1, will knife downwardly into the bottom structure until firm anchoring is achieved. When the forward motion of the force applied through the cable 26 causes the anchor to move forwardly, drag on the bottom water course by the anchor end which is against the bottom structure will cause a longitudinal sliding movement of the relative parts to extend the flukes into the water course bottom structure but separate the retractors into a rearwardly extended position as shown in FIG. 5. The forwardly placed relative position is shown in the phantom in FIG. 2 for comparison.

The terminal attachment 30 on the forward end of the retractor will cause a pivoting effect on the anchor as is best shown in FIG. 1. The further back the attachment of the sheath is with respect to the anchor, the more the tendency will be to stand the anchor nose down. Hence it is not desirable to have the retractor couple place the pivot point as far as the center of the total anchor structure. Such extreme placement would likely cause the anchor to completely flip over rather than knife into the structure. Hence, it is desired that the retractor couple permit the maximum leverage point to proceed not more than about one-third rearwardly of the length of the anchor fluke plate 10.

Because of the structure thus described, the anchor will lie angled down from the angled ends of the retractors to the opposite end. The angled ends will provide a drag effect on the water course bottom structure as the forward drive through the cables takes place. This drag will cause the fluke plate to shift to a greater extent than the retractor is shifted by actuation of the means which drives the parts in the shifting movement.

Therefore, release of this new and improved anchor is accompanied by a reversal of the insertion of the fluke into the water course bottom structure rather than tearing and forcibly lifting overburden with the fluke. The natural result is a much more easily retracted anchor without the often experienced snagging on objects difficult to physically displace, especially on smaller boats and anchors.

In certain types of bottom structures, it is conceivable that the anchor could lie completely on its side and require considerable forward drag before righting itself and impaling the water course bottom structure. Therefore, stabilizer arms 36 are riveted at 37 to the rear portion of the anchor fluke plate 10 in those models and variations of the invention where stability is to be assured. Even with stabilizer 36, the plate 10 could possibly angle to one side or the other, but would be operative even if a full upright position were not fully regained.

Although this invention is capable of obvious modifications from the preferred embodiment as illustrated, it has been found that the illustrated structure is capable of manufacturing economies as well as efficient functional capability.

The dynamic anchor is for water craft, and the fluke plate is preferably composed of two lateraly spaced flukes connected into planar relationship, although a solid fluke plate is conceivable with a modified anchor retractor.

The retractor illustrated is carried on the fluke plate by being guided in the forward and rear slots described, and the cables as illustrated in this drive, establish a reciprocal shifting capability between a first position wherein the plate and retractor are essentially telescoped together, and an extended position wherein the angled ends of the retractor are positioned well behind the end of the fluke plate.

The cable connection around the turnpost 32 produces a reaction drive of the plate and retractor and moving the parts from the extended to the telescoped position. When the anchor is first introduced into the water course bottom, a straight-forward drag is placed on the anchor and the angled ends of the retractor drag the bottom course and the retractor is not restricted in position with respect to the fluke. Hence the fluke plate will advance with respect to the retractor.

However, when removal of the anchor is desired, and the cable 25 is actuated, a reaction drive of the plate and retractor is introduced in moving the parts from the extended to the telescoped position, whereby the part with the greater resistance to movement will drive the mated member. In this case, when the anchor is on the bottom structure, the angled ends of the retractor will dig into the anchor structure and enhance the capability of the retractor to cause the fluke plate retraction from the anchored condition. It is not necessary that the fluke plate be entirely retracted if the retractor angled end is not capable of biting into the water course sufficiently, it will nevertheless cause some retraction of the fluke plate and materially enhance the capability of lifting the fluke plate from the overburden remaining.

What is claimed is:

1. A dynamic anchor for watercraft, comprising:

a fluke plate including two laterally spaced flukes connected into a planar relationship establishing a longitudinal slot therebetween with the edges of said flukes defining guide rails;

an anchor retractor comprising two retractor parts positioned together by means extending between said retractor parts and through said slot enabling said retractor to be guided by said guide rails;

said retractor being reciprocal relative to said fluke plate between an extended position and a retracted position;

means for producing a drive between said retractor and said fluke plate for moving said retractor between said extended and retracted position;

hook means on said retractor angled relative to said fluke plate for engagement into the water course bottom to enhance the relative movement between said fluke plate and said retractor;

said means for providing said drive comprising a first and a second cable;

said first cable being connected to said fluke plate for moving said flukes into the extended position for engaging with the water course bottom; and said second cable being reaved about a turnpost disposed on said retractor and secured to said fluke plate to move said flukes into said retracted position to disengage the flukes from the water course bottom.

2. An anchor as defined in claim 1, including a stabilizer attached to the anchor for preventing the anchor to tilt into an inoperative angle.

3. A dynamic anchor as defined in claim 1, wherein the forward end of the fluke plate is tapered to penetrate into the water course bottom.

4. A dynamic anchor as defined in claim 1, wherein said hook means includes an angled end extending opposite from each of said retractor part.

* * * * *